US005236058A

United States Patent [19]

Yamet et al.

[11] Patent Number: 5,236,058

[45] Date of Patent: Aug. 17, 1993

[54] MOTOR DRIVEN ROLLER SKATES

[76] Inventors: Irving Yamet; Richard Yamet, both of 260 Fifth Ave., New York, N.Y. 10001

[21] Appl. No.: 804,691

[22] Filed: Dec. 11, 1991

[51] Int. Cl.[5] ..... A63C 17/12

[52] U.S. Cl. ..... 180/181; 280/11.2; 280/11.22

[58] Field of Search ..... 180/180, 181; 280/11.2, 280/11.22, 11.23, 11.21

[56] References Cited

U.S. PATENT DOCUMENTS

| | | | |
|---|---|---|---|
| 823,385 | 6/1906 | Beauford | 180/181 |
| 1,694,671 | 12/1928 | Rodelli | 180/181 |
| 1,801,205 | 4/1931 | Mirick | 280/11.22 |
| 4,073,356 | 2/1978 | Schlicht | 180/181 |
| 4,094,372 | 6/1978 | Notter | 180/181 |
| 4,295,547 | 10/1981 | Dungan | 280/11.2 |
| 5,020,621 | 6/1991 | Martin | 180/181 |

FOREIGN PATENT DOCUMENTS

| | | | |
|---|---|---|---|
| 2641702 | 7/1990 | France | 280/11.2 |
| 35107 | 4/1912 | Sweden | 280/11.2 |

*Primary Examiner*—David M. Mitchell

*Attorney, Agent, or Firm*—Nikaido, Marmelstein, Murray & Oram

[57] ABSTRACT

A combination of a conventional roller skate having a platform which supports the skater and axles/wheels below the supporting platform which are mounted in rotational relationship to the platform; and a motor adapted to drive the wheels. In this combination, there is provided a braking system which is operatively associated with the wheels and/or axles and which is operated by hingedly depressing a forward portion of the support platform by means of the forward portion of the skater's foot, such as the toes. Depressing the forward portion of the support platform forces a braking means into effective stopping contact with the wheels. There is further provided a means to start the motor which is associated with the skate. In this embodiment, an auxiliary wheel is provided rearwardly of the skate and out of contact with the surface on which the skate wheels bear. The skater starts skating in a conventional manner, and when enough speed has been achieved, the skate is pivoted about the rear wheels to cause the auxiliary wheel to contact the surface on which the conventional wheels bear. This contact turns the auxiliary wheel which jump starts the motor.

15 Claims, 5 Drawing Sheets

FIG.2
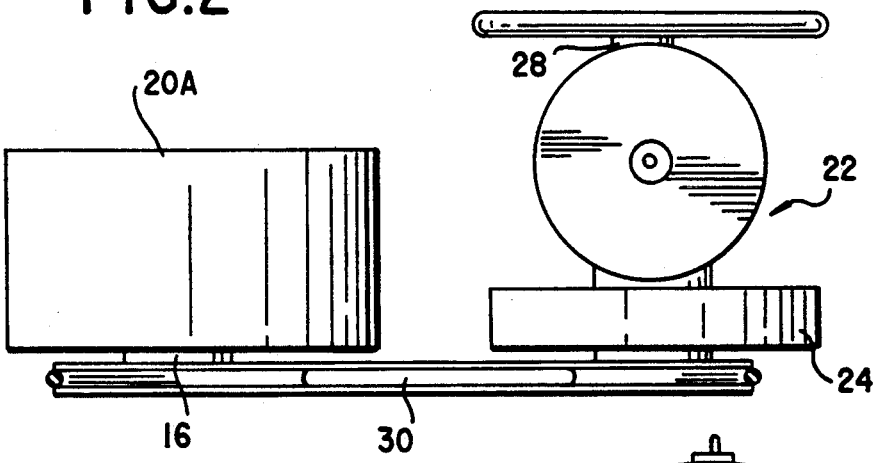
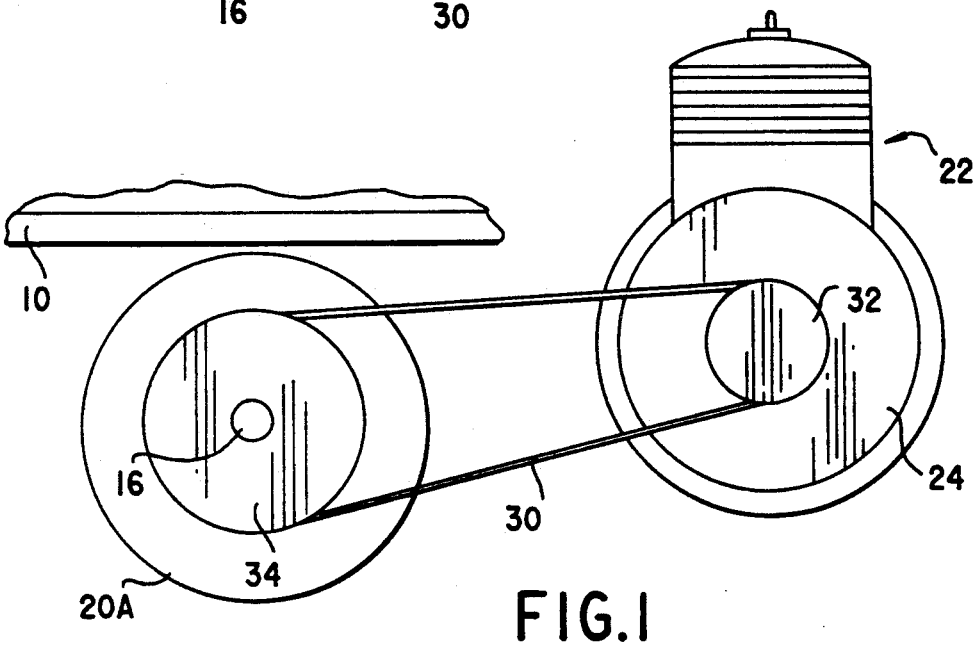
FIG.1
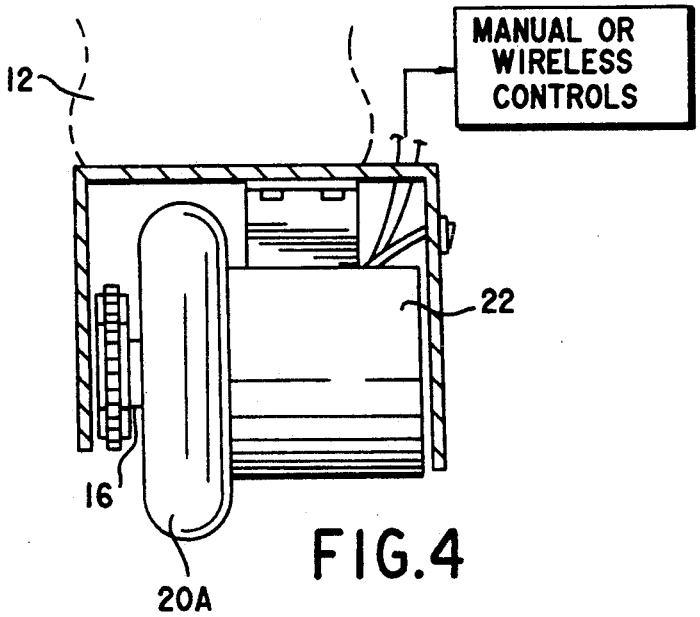
FIG.4

MOTOR DRIVEN ROLLER SKATES

This invention is directed to roller skates. It more particularly relates to roller skates which are operatively associated with powered driving means therefore.

BACKGROUND OF THE INVENTION

Roller skates are well known. They have been available for many decades. In the older type of skate, four wheels are mounted two each on two axles, one in front of the other. In the newer type of skate, each of the wheels is mounted on its own axle, and all of the wheels are mounted in tandem. This newer roller skate is also referred to as a roller blade.

Roller skates are suitably directly coupled to a shoe as a single integral unit, or they may be made so as to be attachable to a shoe. These configurations are equally adapted to implementation with either the two axle, two wheel per axle, or the roller blade type of arrangement.

It has always been the desire of skaters to go faster. Toward this end, skates have become lighter and their construction has been modified so as to minimize friction. Also, in the past, many attempts have been made to provide auxiliary propelling means for skates. However, none of these has as yet seen any substantial commercial success.

Many of these auxiliary propelling means for roller skate have been disclosed to be carried on the person of the skater, that is on a belt or on the back of the skater in the form of an electric motor or an internal combustion engine. Power transmission between the motor/engine and the skate has often been provided by means of a rigid or a flexible power transmission means such as a shaft or a cable.

It is clearly undesirable for such a motor/engine to be carried on the back or the belt of the skater. The power transmission is too long and therefor too much power is lost in the transmission. Further, and perhaps more importantly, the attitude of the skater does not always coincide with the attitude of the roller skates, which may make for either a very complicated power transmission system, or one which may be subject to interruption when the motor/engine being carried by the skater and the roller skates get too far out of functional alignment.

It is therefore believed that it is more appropriate and efficient to provide a means for driving (powering) roller skates which is more proximate to the skate itself. This would be less subject to power transmission failure or interruptions because of these attitudinal differences between the skates and the skater. In this regard, reference is made to U.S. Pat. No. 3,876,032 in which there appears to be described roller skates which are driven by an electric motor which is mounted directly to the skate frame.

In this reference, the electric motor is mounted on the skate frame, suitably to the rear of the rear, or driven, wheels. The motor is directly coupled to the driven wheels, and is powered by a battery power pack which is carried on the back of the skater. Controls for the motor are worn on the skater's belt.

While electric motors have been considered to be suitable for this use, it is well known that electric motors do not put out a large amount of power, and do not run for long on battery power. Further, they are not very effective under high load conditions, such as climbing a hill. Electric motors are advantageous, however, in that they start instantaneously, without cranking, and they do not require the skater to carry a flammable, often dangerous, fuel around to feed the motor.

Given these advantages and disadvantages of the use of personal electric motors to power roller skates, it would still be better to be able to use an internal combustion engine to power roller skates, if the disadvantages thereof, principally the difficulty of startup, could be overcome.

Another problem which has faced skaters is the fact that there has never been an adequate braking system developed for roller skates. Conventionally, a rubbing member is attached to the front (toe portion) of the skates, and when the skater wishes to stop, slow down, or sharply turn about one of the skates as an axis point, the skater tips his foot forward so that the rubbing member touches the ground (floor) with more or less pressure whereby retarding the rolling action of the skate, and causing the skate to slow or stop.

This system has been in use for many years, and has performed quite adequately where the power applied to the skate is limited to the power of the skater. Since the power of the skater drives the skate, the power of the skater can stop the skate. However, where auxiliary driving power, by means of a motor or engine, is added to the skate, the power of the skater to apply this simple means of mechanically pressing a rubbing member against the floor will not be sufficient. The addition of auxiliary power to the skate requires a more powerful and better braking operation.

There has been an increasing interest in recent years in providing alternate means of transportation of people. This is of particular concern in urban areas where the streets have become increasingly crowded with automobiles. The automobile population increase has caused congestion and substantial increases in air and noise pollution.

One of the major problem with the use of automobiles is that the amount of fuel consumed in their operation is proportion to their entire weight, that is the weight of the people and goods being transported as well as the weight of the automobile itself. Where many people, and/or much goods, are being transported, there is a reasonable relationship between the amount of fuel being consumed, the amount of pollution being created, and the total weight of the material/people being transported. Where a large and heavy car is used to transport a single person, a disproportionate amount of fuel is needed to move the weight of the car as compared to the amount which actually is needed to move the weight of the person and goods in the car.

In recent years there has been an effort to reduce the weight and size of cars and thereby increase their fuel efficiency. There have also been efforts to encourage the use of multiple occupancy vehicles in order to increase the proportion of the weight of passengers and freight to the weight of the vehicle itself.

Public transportation is, of course, one solution to this problem. However, many people do not like to use public transportation, and will not if they can use their cars. Further, even where public transportation is used, there is often some distance between the public transportation stop and the ultimate destination of the rider. These deficiencies raise a need for alternative transportation means.

In other countries, and to a lesser extent here in the United States, bicycles, even motored bicycles (mopeds), have been used to transport people. This is much more efficient from a fuel conservation perspective, but bicycles still take up a fair amount of room on the streets, several times as much room as the person riding the bicycle would take up if that person was walking.

While all of these efforts are admirable, there is still need to provide more efficient transportation which will reduce the amount of fuel needed per weight of people and goods being transported.

OBJECTS AND BROAD STATEMENT OF THIS INVENTION

It is therefore an object of this invention to provide a novel roller skate assembly which is operatively associated with auxiliary propulsion means.

It is an important object of this invention to provide an internal combustion propelling means for roller skates having a novel starter assembly means.

It is another object of this invention to provide an assembly of roller skates coupled to auxiliary internal combustion power generating engine means available to assist in propelling the skates.

It is a further object of this invention to provide a novel means to start an internal combustion engine which is directly coupled to roller skates which does not suffer from the disadvantages of prior engine starters.

It is a still further object of this invention to provide novel braking means for use in conjunction with roller skates, with or without auxiliary power means being available to drive the skates, or either of them.

Other and additional objects of this invention will become apparent from a consideration of this entire specification, including the drawing hereof, as well as the claims appended hereto.

In accord with and fulfilling these objects, one aspect of this invention is the association of an internal combustion engine operatively coupled to at least one roller skate. According to this aspect of this invention, the internal combustion engine is desirably mounted on a skate frame in close proximity to at least one of the wheels or axles of the skate. The engine may be mounted in front or behind the driven wheel(s), or it may be mounted on the outboard side of the wheel. It is also within the scope of this invention, in a two axle, two wheels per axle, configuration skate, to dispose the engine, if it is small enough, between the front and the rear axles under the skate frame or platform. In this regard, it may be desirable to increase the distance between the skating surface, that is the floor or the road, and the skate platform or shoe in order to provide enough room for the engine.

The controls for the engine of this invention are suitably proximate to the hand(s) of the skater. They may be held in the skater's hand, or they may be suitably attached to a belt or other similar article which is worn by the skater in a location which is convenient to the skater's hand. The controls may be operatively associate with the engine by means of a cable or by wireless radio.

Where there are two engines, one for each skate, either a single control, which operates both skate engines simultaneously, or dual controls may be used. However, in the case of using dual controls with dual engines, it is desirable that the two sets of controls be at least somewhat coupled so that the power of the engines can be attuned to each other, whereby preventing, or at least minimizing, the possibility that the two engines are powering the two skates at substantially different levels and thereby causing the two skates to be propelled out of synchronization.

The novel combination of a roller skate and an internal combustion engine powering the same is remarkably enhanced by the application of a novel starting system for the engine, and one important feature of this invention is the means which is used to start the engine. Many small internal combustion engines are not provided with self starters, such as those which are used for starting automobile engines. These devices require a battery, take up a great deal of room, and add a large amount of weight which the engine must then also drive. Rather, a crank pulley is often provided whereby the user winds a rope around the engine crank shaft, primes the carburetor, or the cylinder directly, and then cranks the engine by pulling the rope whereby "jump starting" the engine.

While this may be an effective means of starting an engine it is an undesirable way in which to start an engine which is operatively connected to the feet of the user (skater). It would mean that every time the skater wanted to start his engine, he would have to bend down and wind a starter rope around the crank shaft, and pull it strongly to jump start the engine. This would be difficult enough with the skater standing still. It would be next to impossible to do while the skater was in motion.

The cranking motion would tend to pull the skater off balance and might cause him to fall. Further, when the engine actually started, if power transmission was not through a clutch, it would also tend to jerk the skater and likely cause him to become at least unbalanced and perhaps even fall.

Of even greater discomfort, difficulty and danger, both to the skater as well as to the people around him, is the fact that the skater would have to take his eyes off where he was travelling in order to assemble the pulley rope to the crank shaft while bending over to substantially touch his toes. Further, many skaters, particularly inexperienced ones, may not be able to bend this far while maintaining their balance.

Therefore, one important feature of this invention is the means which is used to start the engine. According to this invention advantage is taken of the fact that the skater can start the skates in motion manually. After the skate wheels are already in motion, then the engine would be started. In this case, the motion of the skate wheels, or the momentum of the skater, is used to crank the engine. Starters of this general type are used with motor driven bicycles, such as mopeds. The rider powers the starting of the bicycle and, after the bicycle has attained a certain speed, the rotation of the bicycle wheels starts the engine, which then takes over, or complements, propulsion of the bicycle.

In a comparable skate application of this principal, the skater starts to skate in the conventional way, as if there was no auxiliary propelling means. When enough speed is built up by the skater's own efforts, a clutch can be manually or automatically engaged so as to couple the wheels of the skate with the engine. The momentum in the wheels will crank the engine, and get it jump started.

Whereas a person sitting on a bicycle could easily withstand the jerking motion accompanying the jump start of an internal combustion engine, it will be much more difficult for a skater, particularly an inexperienced skater, not to lose his balance as the engine jump starts.

Of course, if a clutch is provided, the engine can be jump started without it having an adverse effect on the balance of the skater. However, clutches add weight which must then be driven. One of the important objects of this invention is to minimize the weight carried by the propulsion system so as to be able to apply the maximum proportion of propulsive force to the movement of the skater.

Therefore, while a rope pull jump starting system is operative for the engine driven skate of this invention, it is less than desirable. Therefore, a different means of starting a skate driving engine is proposed by this invention.

Thus, another aspect of this invention is the provision of a novel means to start an internal combustion engine operatively associated with a roller skate. According to this aspect of this invention, a separate starter wheel is provides operatively associated with the engine such that when the starter wheel is turned, it in turn drives the crankshaft of the engine. In a preferred embodiment of this aspect of this invention, the starter wheel is separately driven at the will of the skater. As this wheel is driven, it drives the crankshaft of the engine, and, if fuel is supplied and if the spark-plug is powered, the engine will be jump started by the action of this wheel.

The skate(s) having an engine operatively associated therewith is provided with the auxiliary starting wheel which is disposed, under normal operating conditions, to be out of contact with the skating surface. This auxiliary starting wheel may be forwardly, rearwardly or sidewardly disposed in relation to the engine and the skate itself. It is suitably directly coupled to the engine crankshaft, or it may be coupled thereto through a conventional clutching mechanism.

In implementing this embodiment of this invention, the skater starts the skate in motion by his own power, while preferably keeping all of the fuel supply to the engine and the electric power to the engine spark plug off. When the skater has built up sufficient speed the fuel valve is opened to prime the engine, that is to allow fuel to feed to the engine (carburetor or injector means). When the engine has been primed the switch which allows electric energy to flow to the spark plug is closed. At substantially the same time, or very shortly thereafter, the skate(s) frame carrying the engine is pivoted about the skate axle, which is proximate to the engine starting wheel, a distance sufficient to engage the engine starting wheel with the skating surface. This engagement causes the starting wheel to be rotated. The weight of the skater can be carried by the other skate during this starting operation.

In the embodiment of this aspect of this invention where the starting wheel is mounted rearwardly of the skate frame, the skater will rotate this skate about its rear axle to raise the toe end and front wheels of the skate, while keeping the heel end and rear wheel(s) of the skate engaged with the travelling surface. When the toe end has been raised high enough, and the skate frame has pivoted about the rear axle far enough, the engine starting wheel will become operatively engaged with the travelling surface so that the wheel will be rotated. This rotation of the engine starting wheel in turn will crank the engine and jump start it.

In this embodiment of this invention, where the motion of the skate is used to crank the engine, care must be taken by the skater because immediately when the starting wheel becomes engaged with the travelling surface, there will be a drag imposed on the skate which might cause the skater to lose balance and fall. The technique of engaging the starting clutch will be acquired with practice. Where two engines are used, one to power each skate, it may be appropriate to start one engine and keep the skater's weight on the other skate so that the drag will be limited to one side and will not unbalance the skater. Once one skate engine has become started, it will have enough power to propel the skater on one skate while the engine starting wheel of the second skate is engaged and that engine started.

Alternatively, the engine powered roller skate of this invention may not have an auxiliary starting wheel, but may have the engine directly coupled to so many of the skate wheels as are desired to be driven. In this embodiment, as the skate is initially propelled by the skater, the engine crankshaft is caused to be driven and, when the fuel is allowed to pass to the engine and the electric power is allowed to activate the spark plug(s), the engine will thus jump start. The engine is then running and being directly coupled to the driven wheels, drives the skate wheels. The skater simply pushes off, and when the skate wheels are turning fast enough, the engine starts.

Another aspect of this invention is a braking system for use in connection with roller skates. It was observed above that some braking systems for roller skates are well known and have been in use for many years. However, the existing braking systems are not intended to be used in conjunction with skates which are being driven by an internal combustion engine. While the existing braking systems may be sufficient to stop or slow down roller skates which are only powered by the muscles of the skater, a much more efficient braking system is needed where the roller skates are powered by an internal combustion engine, such as a hydraulic or mechanically activated system.

Further, where a hydraulic or mechanical braking system is to be provided for use with roller skates, special means must be provided to activate and control the system. By contrast, in an automobile, the brakes are applied by stepping down on the brake peddle. It is possible to operate the braking system of an automobile in this manner because the driver is sitting down and his foot is not involved in carrying the drive's weight. In a roller skating application, the skate is carrying the weight of the skater through his foot (feet). Therefore it is not possible to use the downward pressure from the foot to activate and control the operation of brakes in connection with roller skates.

One solution to this problem of activating and controlling a braking system in connection with engine driven roller skates, is to provide a hand braking system, similar to the hand brakes on a bicycle. However, the design of such a hand operated braking system this is a difficult engineering problem. The hand brakes on a bicycle are affixed to the rigid frame members thereof. Thus, when the hand squeezes the brake lever, the squeezing power is transmitted through a cable affixed to the frame, to the brake means associated with the bicycle wheel(s). In a skate application, there is no rigid means between the skater's hand and the skate for the brake mechanism cable to be affixed to. Therefore, while this sort of mechanism is adapted to use in connection with roller skates, the application of it to this problem will be difficult because of the lack of structural members to affix the brake actuating system to. The amount of pressure which can be applied to the brakes, by squeezing a hand held brake control without supporting structure will be most difficult to control.

According to another aspect of this invention, there is provided a braking means associated with at least some of the roller skate wheels which is activated by the skater's foot. In this manner, there is no need for a rigid means to attach a brake cable or a hydraulic line to. Because the full weight of the skater is carried by the pair of skates which are worn by the skater, and because there is nothing against which the skater can obtain additional leverage in order to pressurize the brake system, another brake activating means needs to be found and implemented.

One embodiment of this aspect of this invention lies in providing a conventional mechanical, or preferably hydraulic, braking means in operative association with at least one, preferably some, of the wheels of the roller skates of this invention. Since the weight of the skater is being carried by the skater's foot, the pressure on the hydraulic or mechanical system which is needed to activate the brakes is applied by the skater depressing only the forward portion of the foot, preferably only the toes on the foot associated with the skate to be braked.

The toe plate portion of the platform of at least one of the skates is hingedly constructed so as to allow it to pivot a small distance in the vertical direction about a horizontal axis. A small piston (hydraulic) or mechanical means is provided under the skater's toe plate in the direction of pivot, so that the depressing of the toe plate will pivot it and will exert pressure on the piston, or will move the mechanical means to activate the braking means associated with the skate wheels. The harder the skater depresses the toe plate, the greater will be the braking action. This plate can be spring loaded to maintain the brake in an inoperative condition unless and until the skater depresses it to activate the brake.

The skater's weight will be supported by the rearward portions of the shoe/platform, allowing the toes to be the controlling means. If great braking pressure is required, the skater can shift his body weight forward, causing more of their body weight to press on the pivotable toe plate and thus increasing the braking pressure.

BRIEF DESCRIPTION OF THE DRAWING

Understanding of this invention will be facilitated by reference to the accompanying drawing in which like parts have been given like reference characters regardless of the view. In this drawing:

FIG. 1 is a side elevation view of an assembly according to this invention, of one configuration of a roller skate wheel including a schematic view of an engine for driving the roller skate wheel;

FIG. 2 is a top view of this same assembly;

FIG. 4 is a partial rear view of a roller skate wheel and axle and the ends of the control cables therefor;

DETAILED DESCRIPTION OF THIS INVENTION

Figure 3:
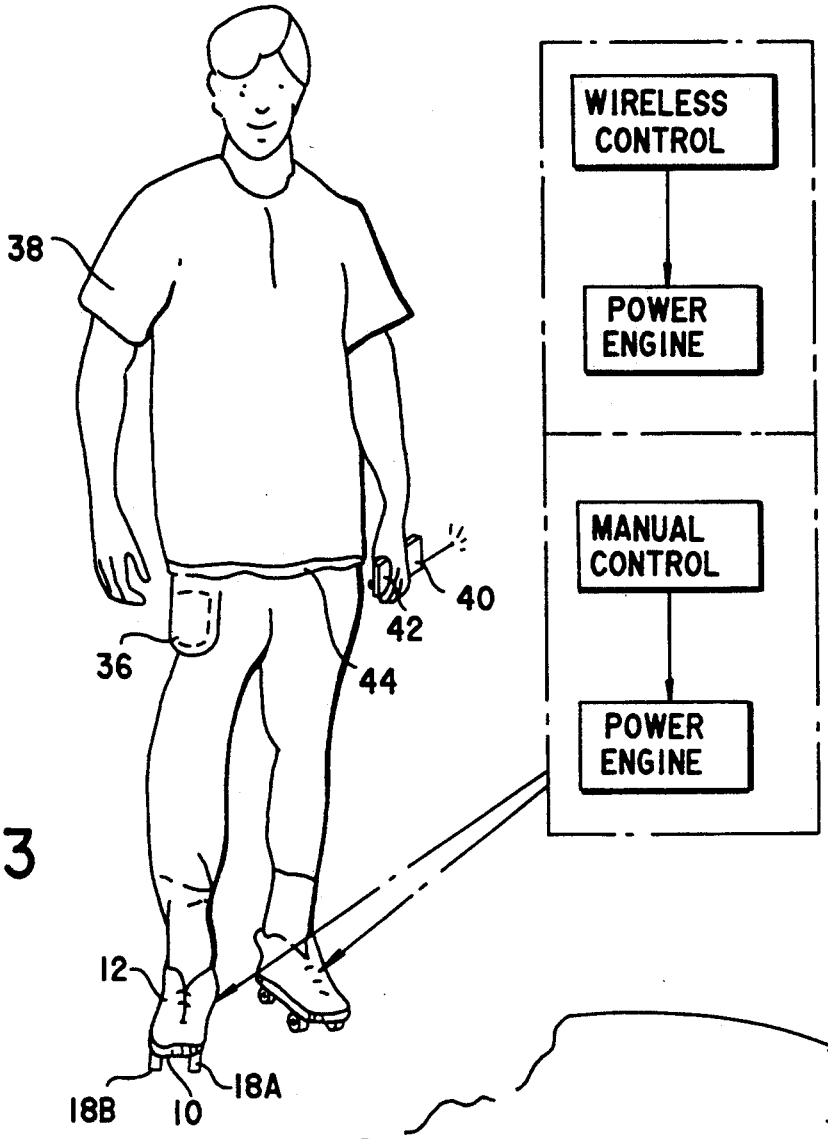
FIG. 3 is a perspective view of a two axle roller skate operatively associated with an engine, including the skater and the controls, according to this invention.
Figure 7:
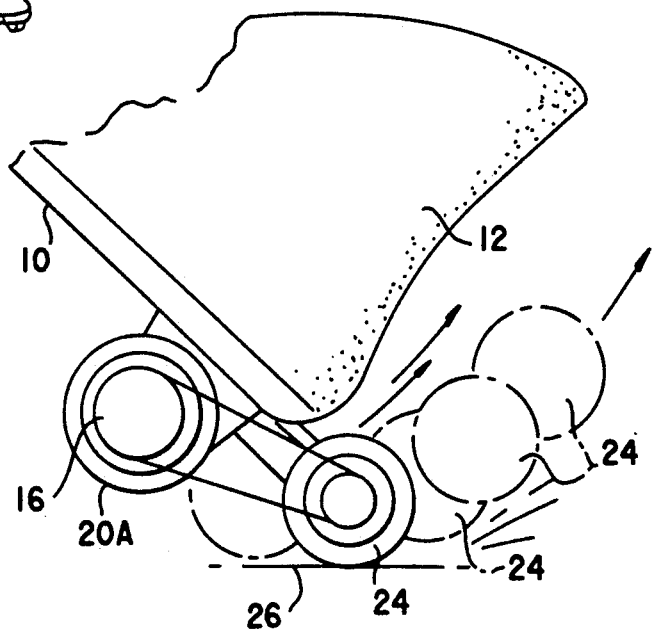
FIG. 7 is a partial side view of a starting mechanism in operation according to this invention.
Figure 5:
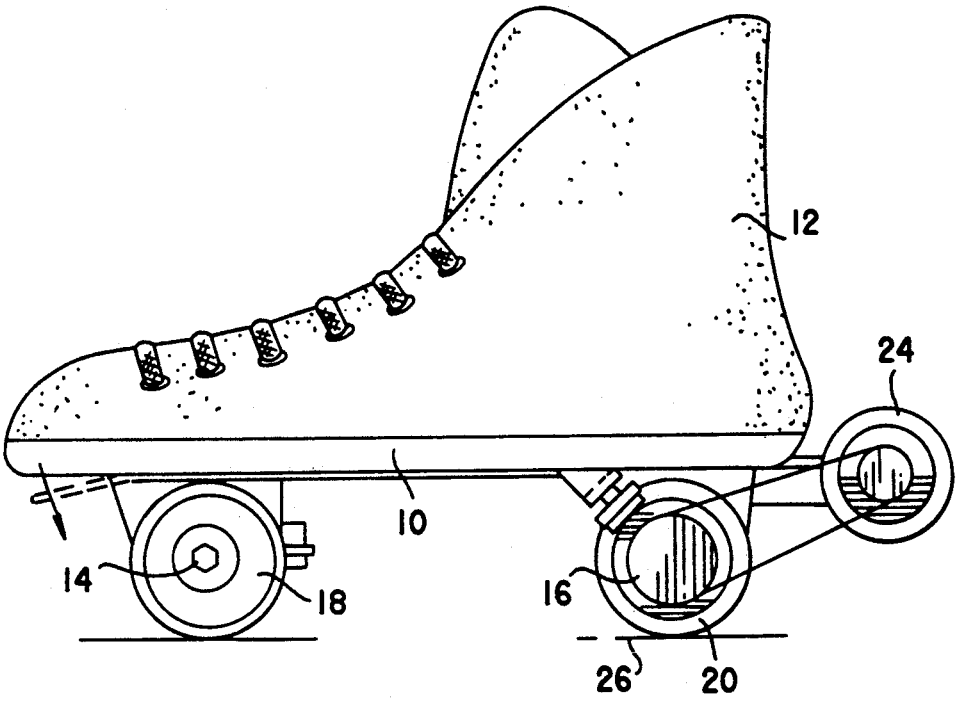
FIG. 5 is a side elevation of an engine-driven roller skate and shoe showing a starting and a braking means according to this invention.
Figure 6:
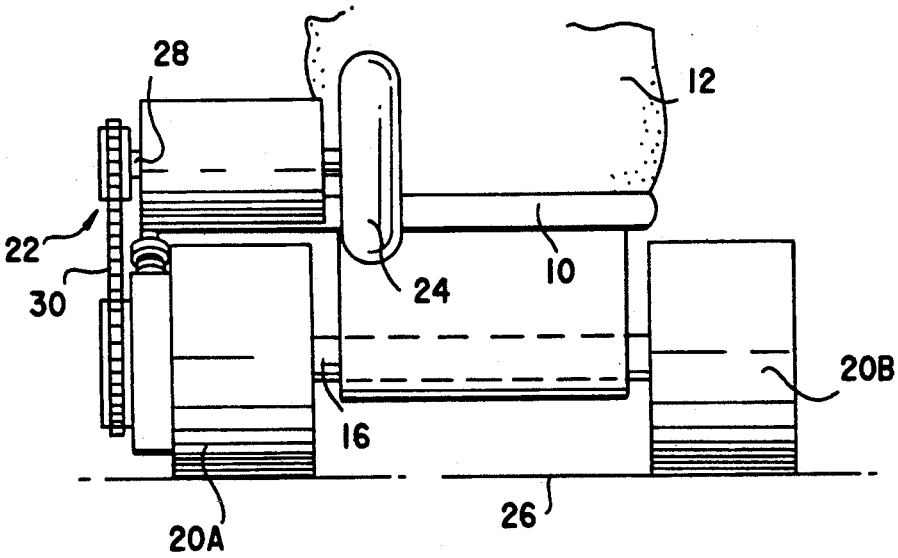
FIG. 6 is a rear view of the assembly shown in FIG. 5.
Figure 8:
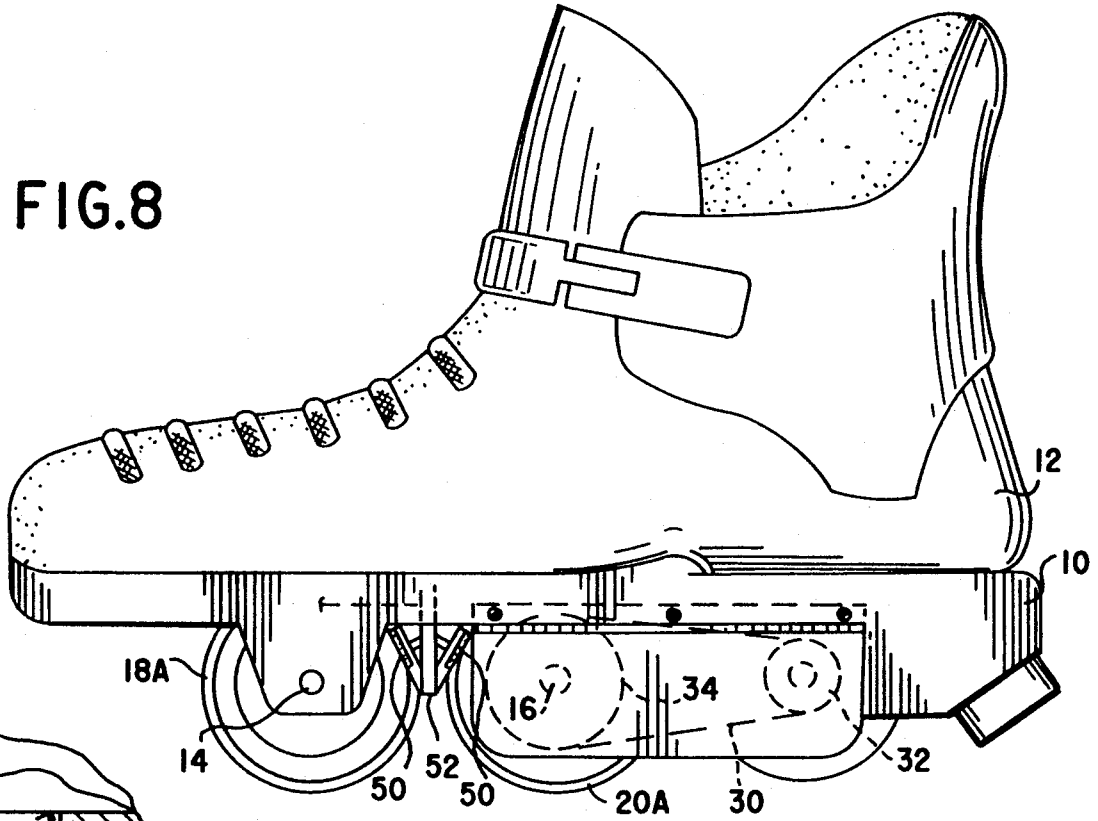
FIG. 8 is a side elevation showing a braking mechanism according to this invention.
Figure 12:
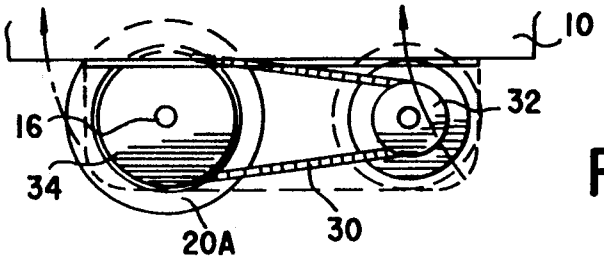
FIG. 12 is an enlarged view of the engine/wheel assembly of this invention.
Figure 9:
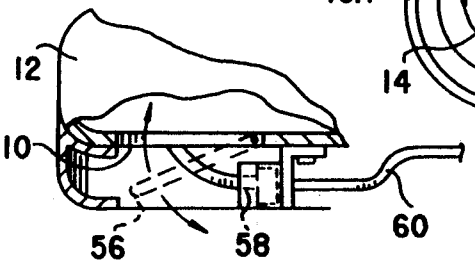
FIG. 9 is an enlargement of the brake initiating mechanism shown in FIG. 8 with portions of the skate and the shoe broken away for ease of understanding.
Figure 11:
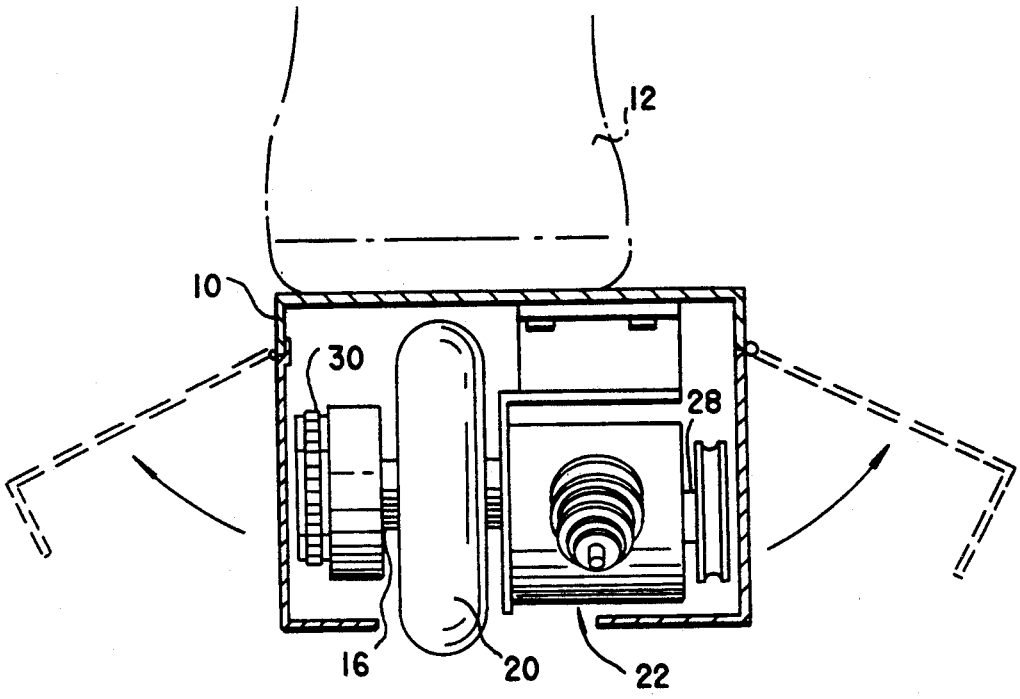
FIG. 11 is a rear view of a the embodiment shown in FIG. 8.
Figure 10:
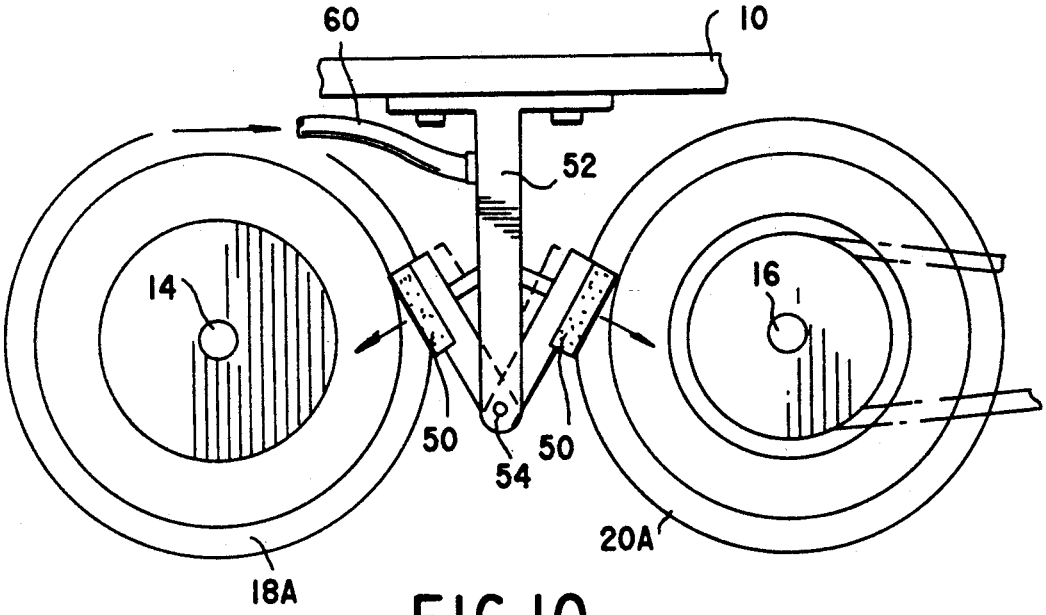
FIG. 10 is an enlargement of the brake actuating mechanism shown in FIG. 8.

In understanding this invention, it is important to note that the internal combustion engine which is being used herein is itself conventional. Substantially any conventional internal combustion engine is suited to use in this invention. For example, two (2) cycle piston driven engines, where the oil is mixed with the fuel, are suitable; four cycle piston driven engines are suitable; gas turbine engines, and rotary engines are all suitable.

Because the space which is available for the engine to be closely operatively associated with a wheel or wheels of a roller skate is limited, it is preferred that, if the engine is piston driven, it be a one cylinder engine, such as the type that is often used to power model airplanes. However, except for the limited space that may be available for mounting the engine, there is no functional limitation on the size or the style of engine that can be used in this application.

It is important that the engine be well insulated at least in the areas thereof which are proximate to the various parts of the skater's body, such as their feet and legs. It is also important that the exhaust system for the engine be located in a position such that the hot exhaust gases will be outwardly directed and will not be impinged against the skater.

One safety feature, which is not necessary to the practice of this invention but which is most desirable to have, is an automatic shut off system which may be suitably responsive to the attitude of the engine and/or the skater, or in fact to any other predetermined condition under which it is desired to have the engine operation automatically terminate. Automatic shut-down devices associated with driving engines are per se well known. They are sometimes referred to as dead-man switches. In essence, they only allow the operation of the engine when the operator exerts some positive action, or is in a predefined positional attitude.

One example of such a "dead-man" switch is a positively acting switch which requires the skater to positively hold open a valve which allows the passage of fuel to the engine. If the valve is not positively held open, it is loaded, such as spring loaded, to close automatically, whereby the fuel supply will be shut off, and the engine will starve. Another such device operates on the basis of the gravitational orientation of the skate. This type of switch or valve remains open only when the skate is either in a proper skating position, that is a vertical, or nearly vertical position relative to the travelling surface being skated on. It can be mechanical, that is control the fuel supply, or electrical, that is control the passage of current to the engine ignition system, such as a spark plug, or any other system which is suitably designed for its function.

The engine can be coupled to at least one driven skate wheel, or axle, in a manner whereby to propel such, by any of the known power coupling means. Suitable engine drive coupling means are exemplified by a vee belt pulley, a worm drive, a gearing system, and a chain drive. If desired, a friction clutch can be provided between the engine and drive coupling means so as to afford the skater additional control over the engagement or disengagement of the engine to the skate wheels.

Although it may be quite sophisticated, and is by no means required by this invention, one aspect of this invention provides for multiple gearing between the engine and the driven wheel means, thus allowing the skater to choose a suitable gear ratio between the engine and the driven wheel means. Conventionally designed bicycle type derailleurs, which have been suitably miniaturized, can be used for changing gears while on the move.

It is within the spirit and scope of this invention to directly couple the engine to the driven wheels or to couple the two together through clutch means. Where a clutch is used, it can be of any of the conventional types of clutches which operate through frictional engagement of a drive member with a driven member.

Where a clutch is not used, and the driven wheel means is directly connected to the engine means, it is considered to be appropriate to start the engine through the momentum of the skate wheels themselves. Thus, in the arrangement wherein there is a direct connection between the wheel means and the engine means, the skater will start skating in the conventional manner, using his muscle power to drive the skates/wheels forward. In propelling the skate, the skater will necessarily also be turning the engine over. As the skate is propelled faster, the engine is turned faster. At some point, when the skater allows fuel to enter the cylinder and the spark plug to operate, the engine will jump start and then will take over the wheel driving function.

In one embodiment of this aspect of this invention, only one skate is driven. Thus, when the skater wishes to stop, he closes, or at least reduces, the throttle, applies the brakes, and, as he slows down to a near stop, he simply raises the portion of the driven skate corresponding to the driven wheel, so as to disengage the driven wheel from the skating surface (usually the heel portion of the skate). At the same time, he releases his brakes. Since the driven wheel is under no load, it will not cause the engine to stall. The engine will continue to idle so long as the driven wheel is kept out of contact with the skating surface.

When the skater wishes to resume forward motion, he simply advances the throttle in the usual way until the engine is turning fast enough to overcome the load of contacting the driven skate with the skating surface. At that point, he drops his heel to force the driven wheel into contact with the skating surface and he is on his way.

Alternatively, the brakes on the driven wheel could be eliminated altogether. In this case, the skater need not be so skillful. He would simply apply the brakes as he sees fit, and just raise the driven skate out oif contact with the skating surface as he comes to a stop.

It is considered to be within the spirit and scope of this invention that either the front or the rear wheel can be the driven wheel. If the front wheel is the driven wheel, the same procedure as set forth above would be followed, but, as the skater comes to a stop, he would lift the tow of the skate off the skating surface instead of the heel.

It is considered to be within the spirit and scope of this invention to use a skate braking system in combination with this directly driven skate embodiment. This braking system may be the conventional skate braking system which has formerly been used in connection with roller skates, or it may be a more sophisticated braking system such as is described in this specification.

There is a known device, referred to as a centrifugal clutch, which operates on the basis of the centrifugal force applied to it. The clutch means is a shaft with a radially outwardly expanding movable means thereon and a fixed circumferential means at the outward limit of expansion. As the shaft turns, centrifugal force causes the outwardly expanding means to move radially outward of the shaft toward the fixed circumferential member. The faster the shaft turns, the further out the radially expanding member progresses until it comes into contact with the fixed circumferential member, whereupon the two members become frictionally engaged.

As the members begin to engage, there is slippage between them. Increasing the rotational speed of the shaft, and therefore moving the radially expanding means outwardly, increases the engagement between the members and reduces the slippage until the outer, fixed circumferential means is turning at the same speed as is the radially expanding means. Further increasing the shaft speed linearly increases the rotational speed of the circumferential member.

Thus, after the engine is started, it can be power coupled to the driven wheel/axle through a centrifugal clutch which operates as set forth above. As the throttle of the engine is advanced, its crankshaft increases in rotational speed, causing the centrifugal clutch to first engage and then to transmit the rotational speed to the driven wheels. As the engine is shut down, that is it is throttled back, the clutch disengages, releasing power to the driven wheels and the skater slows down by reason of friction between the wheels and other surfaces.

Where desired, the wheels of the skate have brake means operatively attached thereto which are exemplified by disc brakes or brake shoes. As noted, They may be operated mechanically, hydraulically or magnetically for example. The brake means may also be coupled to the clutch and power transmission means so that when the brakes are operational, the clutch is disengaged automatically. In this manner, the engine is not caused to apply power to the wheels while the brakes are trying to stop them.

Means must be provided for carrying fuel for the engine. This can be accommodated by means of a fuel tank which is carried by the skater, suitably on his back or on a belt. In this configuration, the fuel storage means, or tank, should preferably be flexible so as to conform to the skater's body and thereby not add substantial distortion. The fuel tank may also or alternatively be disposed in the vicinity of the skate platform, that is over, around or under the skate platform.

This is a particularly suitable arrangement where the engine is mounted to the front or rear of the skate axles, thereby leaving a substantial amount of room between the front and the rear axles under the skate platform. Additionally, placing the fuel supply closer to the engine simplifies the design and assembly of the system. It also reduces the risks involved with having a highly flammable fuel, like gasoline, in very close proximity to the skater's body. In either case, or wherever else the fuel supply may be mounted, the fuels storage means, or tank, should be made of a very strong, abrasion resistant, self sealing material so that in the event of a fall it will be less likely to tear, puncture, or rupture, and, if the fuel container does become inadvertently opened, the self sealing characteristic of the container will serve to minimize any leakage, and thereby act to prevent, or at least minimize, the fire hazard.

This invention will now be described with reference to the accompanying drawing. This description is presently considered to be the best mode of carrying this invention into practice. In this description, a skate with a forward axle and a rearward axle, significantly spaced apart from the forward axle so as to define a significant space therebetween, has been chosen to illustrate the invention. Each of the axles carries two spaced apart wheels. However, this invention is by no means limited to this preferred mode of operation. It is contemplated that further modifications in the operation and components of this invention may be made without departing from the spirit and scope of this invention. These are intended to be included within the scope of the instant invention.

Referring now to the drawing: a skate frame 10 is provided, which is suitably conventionally attached to a shoe means 12. On the underside of the skate frame 10 there are disposed a forward axle 14 and a rearward axle 16. Each of these axles has one outboard and one inboard wheel 18 A and B and 20 A and B, respectively, rotatably attached thereto.

Mounted rearwardly of the rearward axle 16, is an internal combustion engine 22, which is suitably a one cylinder, two cycle engine. This engine is suitably directly coupled to a rearwardly disposed engine starting wheel 24 which is mounted such that it has clearance from the surface 26 on which the skate is travelling. The starting wheel 24 is preferably directly coupled to the drive haft 28 of the engine. However, it is within the scope of this invention to provide clutch means (not shown) between the engine starting wheel and the engine drive shaft so that, after the engine has been started, the wheel can be disconnected therefrom. The engine 22 is fixedly mounted to the skate frame 10 so that its orientation to the travelling surface and to the driven wheels of the skate will not substantially vary.

The engine 22 is suitably coupled to a driven rear axle 16. Coupling to this particular axle is not essential to the practice of this invention. It is contemplated that the engine could also, or alternatively, be coupled to the forward axle 14, or even to both axles. It is also contemplated that the engine could be directly coupled to one or more skate wheels rather than an axle. Coupling between the driven wheel or axle means and the engine is shown to be by means of a vee belt 30 extending between a first pulley 32, preferably directly coupled to the engine drive shaft 28, and a second pulley 34, preferably directly coupled to the wheel or axle means which is intended to be driven.

A fuel tank 36 is suitably mounted and positioned on the skater 38. A single, multicomponent cable, or a bundle of cables suitably collected together or a wireless transmitter 40, is coupled to the engine 22 and is adapted to be held in the skater's hand 42 or attached to the skater's belt 44. This control panel comprises means to control the amount of fuel and the spark advance, that is an accelerator, 44. The transmitter should be such that in the event that the skater lets it go, intentionally of unintentionally, the engine will at least revert to an idle mode, or, preferably cause the engine to completely shut down, whereby no driving force is applied from the engine to the skate.

One suitable braking system for the engine driven skate of this invention is one which employs conventional brake shoes 50 which are disposed proximate to the wheels 18 A and 20 A against which they will bear when actuated. The brake shoes 50 are suitably mounted on a member 52 which depends from the skate platform 10. The brake shoes 50 are hingedly 54 mounted such that when they are operated, they are moved away from the supporting member 52 into operative contact with the wheels 18A and 20A. Operation of the brake shoes is suitably accomplished by depressing the toe plate 56 of the skate platform 10 whereby to pressurize a hydraulic cylinder 58 which in turn forces hydraulic fluid through a suitable conduit 60 into operative association with the brake shoes 50. Conventional brake design will be appropriate to this application.

The employment of conventional safety precautions and devices are considered to be within the scope of this invention, and their use is recommended. These include helmet means for the skater as well as suitably disposed padding, such as on the elbows and knees, and gloves. It is, of course, within the scope of this invention, and it is indeed recommended, that the skater wear flameproof clothing, at least in the proximity of the engine and the fuel carrying means.

What is claimed is:

1. An assembly of:

A. a roller skate comprising:

a skate platform means adapted to support a skater thereon;

toe plate means pivotally joined to said skate platform means adapted to be operatively associated with a forward portion of a foot of said skater such that downward pressure of said forward portion of said foot of said skater causes said toe plate means to deflect downwardly pivoting about the juncture of said toe plate means and said skate platform means and operatively connected to braking means;

at least two axle means depending from said platform means and affixed thereto;

at least one wheel means affixed to each of said axle means in rotational relationship thereto; and means operatively associated with said skate platform to support a skater;

B. engine means carried by said roller skate drivingly connected to at least one of said wheel means or axle means and including means to provide fuel to said engine;

C. said braking means being operatively associated with at least one of said wheel or axle means and operatively associated with said toe plate means wherein downward pressure of said forward portion of said foot on said toe plate means causes operative engagement of said braking means and said wheel or axle means;

D. means to maintain said toe plate means in a disengaged position such that said braking means is out of effective contact with said wheel means unless and until downward pressure is exerted thereon by said forward portion of said foot of said skater; and E. control means operatively associating said skater and said engine means allowing said skater to control the operation of said engine.

2. An assembly as claimed in claim 1 wherein said skate contains a forward and a rearward axle means, each of which is operatively associated with two wheel means, respectively wherein the contact of all of said wheel means with said skating surface is simultaneous, and wherein at least one of said axle means is operatively coupled to said engine means and is adapted to be driven thereby.

3. An assembly as claimed in claim 1 wherein said skate contains a multiplicity of radially aligned wheels each of which is rotatably mounted on a single axle, and wherein said engine is operatively associated with at least one of said wheels.

4. An assembly as claimed in claim 1 wherein said engine is operatively coupled to said driven wheel through a clutch means.

5. An assembly as claimed in claim 4 wherein said clutch means is a centrifugal clutch.

6. An assembly as claimed in claim 1 including at least one auxiliary starting wheel operatively connected to the crankshaft of said engine and spaced away from a skating surface on which the wheels of said skate are designed to contact during normal operation.

7. An assembly as claimed in claim 1 wherein said brake means is hydraulical.

8. An assembly as claimed in claim 1 wherein said downward movement of said toe plate means hydraulically activates said braking means and causes said brake shoe means to engage all of said wheel or axle means in a braking operation.

9. An assembly of:

A. a roller skate, comprising:

shoe means;

a skate platform means attached beneath said shoe means and adapted to support a skater thereon;

toe plate means beneath said shoe means pivotally joined to said skate platform means adapted to be operatively associated with a forward portion of a foot of said skater such that downward pressure of said forward portion of said foot of said skater causes said toe plate means to deflect downwardly pivoting about the juncture of said toe plate means and said skate platform means and operatively connected to braking assembly means;

means to maintain said toe plate means in a rest position such that said braking means is out of effective contact with said wheel means unless and until downward pressure is exerted thereon by said foot of said skater at least two axle means depending from said platform means and affixed thereto in rotational relationship with respect thereto;

at least one wheel means affixed to each of said axle means in rotational relationship thereto; and B. wherein said braking assembly means comprises: brake shoe means operatively associated with at least one of said wheel means, and brake shoe activation means operatively associated with both said brake shoe means and said toe plate means such that the depression of said toe plate means by said skater activates said brake shoe means into effective braking contact with said wheel or axle means.

10. An assembly as claimed in claim 9 wherein said brake shoe activation means is hydraulical.

11. An assembly as claimed in claim 9 wherein said downward movement of said toe plate means hydraulically activates said braking means and causes said brake shoe means to engage all of said said wheel or axle means in a braking operation.

12. In an assembly of a multiwheeled roller skate and an internal combustion engine comprising: a skate platform, which is adapted to be operatively associated to support a skater; at least two longitudinally separated axle means depending from said skate platform each of which is adapted to interface with a skating surface on which said skate is travelling through at least one wheel means; an internal combustion engine means carried by said skate platform drivingly operatively associated with at least one of said wheel means; fuel means adapted to carry fuel for said engine; means to feed said fuel to said engine; and control means operatively associated with said engine and said skater whereby affording said skater with means to control the operation of said engine means; the improvement which comprises an engine starter means operatively associated with said engine means comprising: auxiliary engine starting wheel means operatively associated with said engine and during normal operation being spaced away from said skating surface and being adapted to be contacted with said skating surface to an extent sufficient that the friction between said auxiliary wheel and said skating surface will turn said auxiliary wheel an amount and with a force sufficient to cause said engine to jump start.

13. An assembly as claimed in claim 12 wherein said auxiliary wheel is mounted such that pivot of said skating platform about one of said axles causes said auxiliary wheel to engagingly contact said skating surface in a manner such as to cause said auxiliary wheel to turn, and to thereby turn said crankshaft an amount sufficient to cause said engine to start.

14. An assembly as claimed in claim 12 further including brake shoe means operatively associated with at least one of said wheels, and including pressure imparting means operatively, associated with a portion of said skate plate for activating said brake shoe means.

15. An assembly as claimed in claim 14 including a pivotable toe plate in said skate platform operatively associated with the forward portion of the foot of a skater, the pivoting of such plate operatively associated with said pressure imparting means.

* * * * *